US005173244A

United States Patent [19]

Laszlo

[11] Patent Number: 5,173,244

[45] Date of Patent: Dec. 22, 1992

[54] SLAG CONTROL APPARATUS AND METHOD

[75] Inventor: William S. Laszlo, Lockport, Ill.

[73] Assignee: Industrial Maintenance And Contract Services Limited Partnership, Munster, Ind.

[21] Appl. No.: 722,524

[22] Filed: Jun. 27, 1991

Related U.S. Application Data

[63] Continuation-in-part of Ser. No. 560,598, Jul. 31, 1990.

[51] Int. Cl.[5] ..... B22D 41/04

[52] U.S. Cl. ..... 266/45; 266/231

[58] Field of Search ..... 266/44, 45, 227, 236, 266/230, 231; 222/590, 591, 597; 75/582

[56] References Cited

U.S. PATENT DOCUMENTS

| | | | |
|---|---|---|---|
| 666,373 | 1/1901 | Baker | 266/231 |
| 1,572,864 | 2/1926 | McKune | 266/231 |
| 1,590,739 | 6/1926 | Evans | 266/231 |
| 1,690,748 | 11/1928 | Moyer | 266/231 |
| 2,528,571 | 11/1950 | Babcock | 266/236 |
| 2,704,248 | 3/1955 | Madaras | 266/231 |
| 3,905,589 | 9/1975 | Schempp | 266/217 |
| 4,390,169 | 6/1983 | LaBate | 266/231 |
| 4,444,378 | 4/1984 | Reese | 266/237 |
| 4,639,927 | 1/1987 | Uno | 266/230 |

*Primary Examiner*—Scott Kastler

*Attorney, Agent, or Firm*—Dressler, Goldsmith, Shore, Sutker & Milnamow, Ltd.

[57] ABSTRACT

A method and apparatus for controlling slag in a tilting furnace are provided. The apparatus comprises a trough having a lateral opening, a discharge outlet, and a passage for defining a non-linear flow path between the lateral opening and the discharge outlet. The method comprises the steps of tilting the furnace to discharge molten metal and slag into the trough, directing the flow of the molten metal through the flow path in the trough, damming and retaining the slag in the trough while permitting the molten metal to flow out of the trough, and discharging the retained slag through the lateral opening in the trough.

36 Claims, 4 Drawing Sheets

Fig. 1
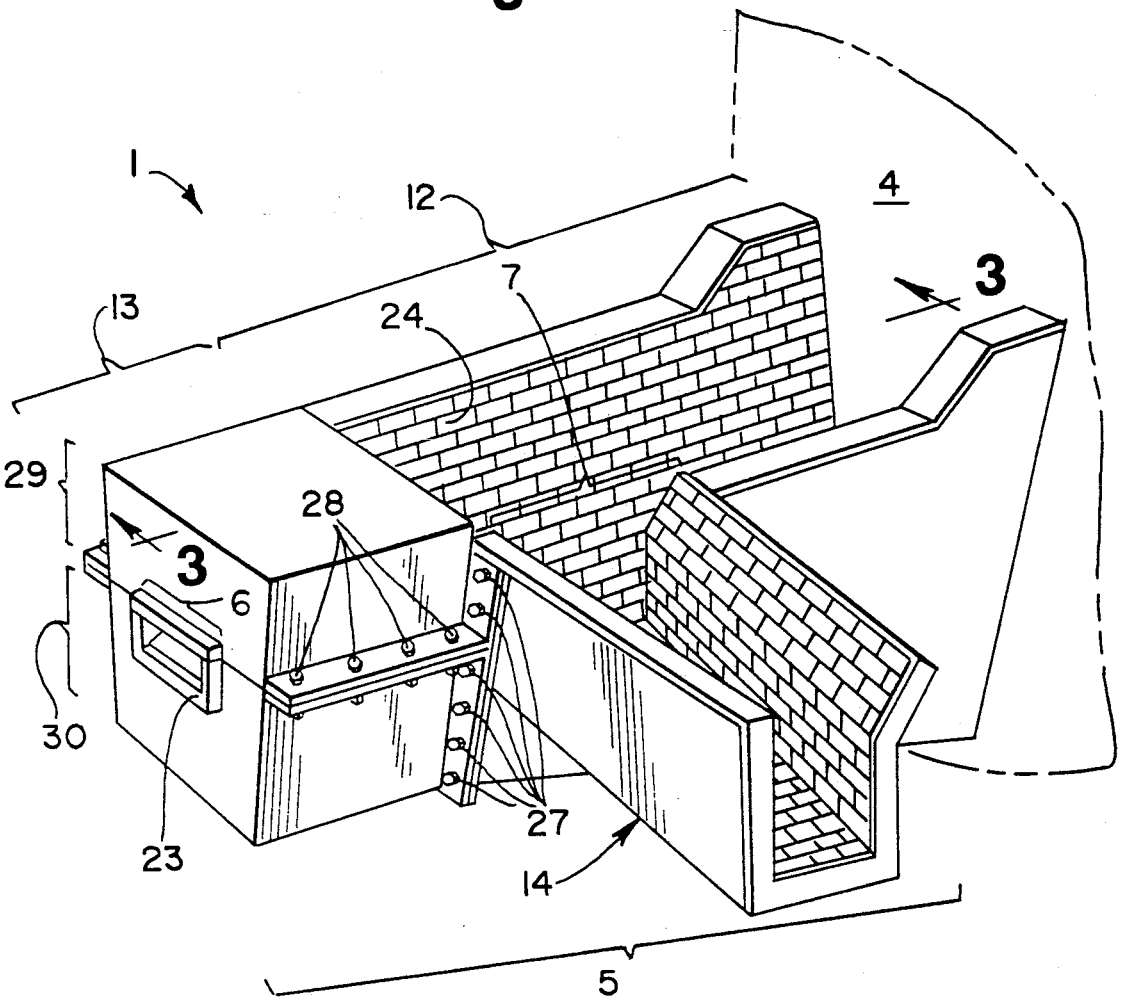
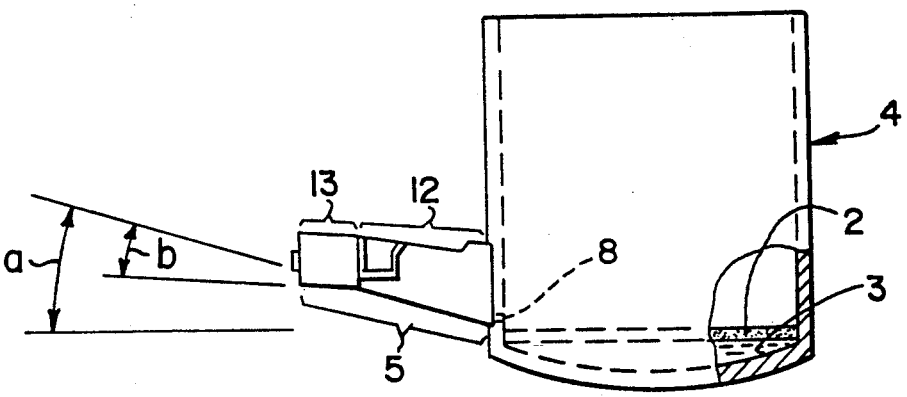
Fig. 2

Fig. 3
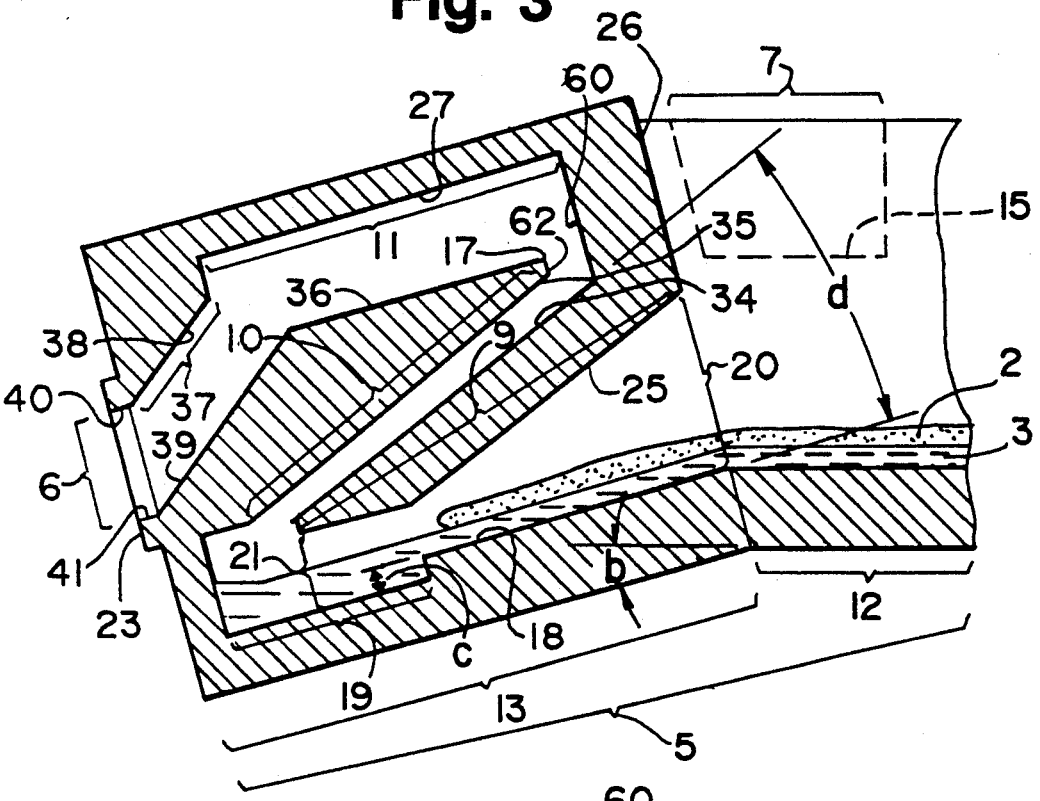
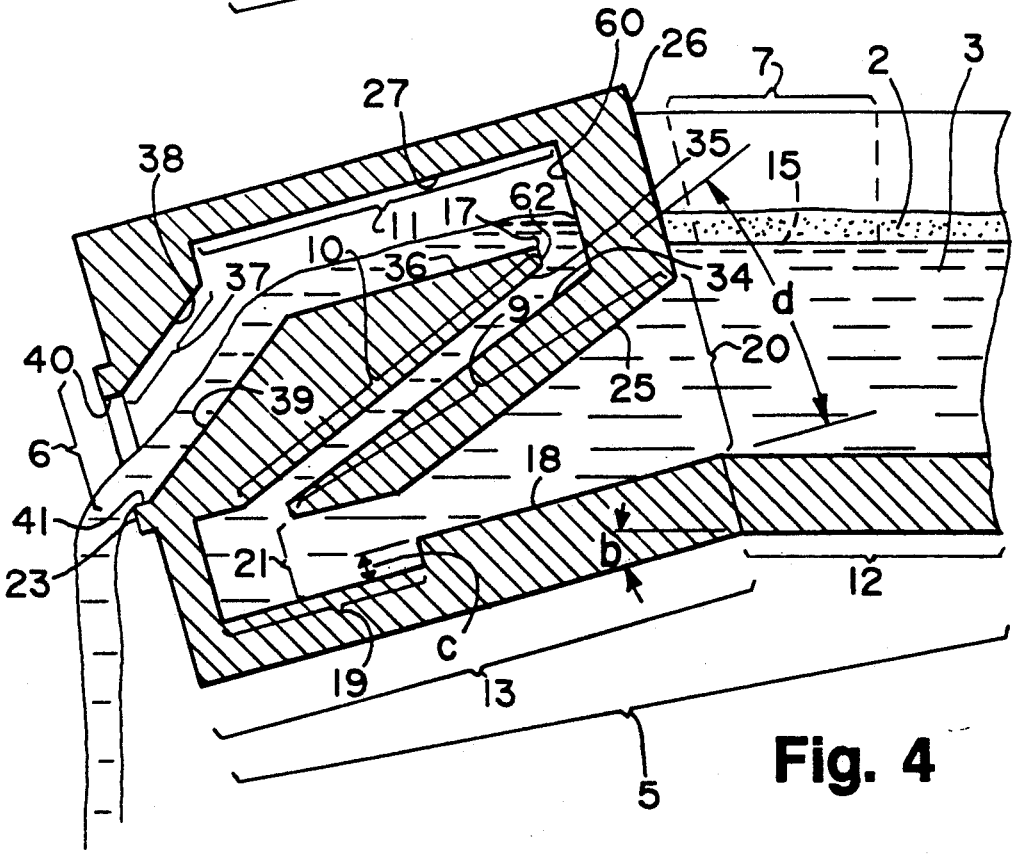
Fig. 4

Fig. 5
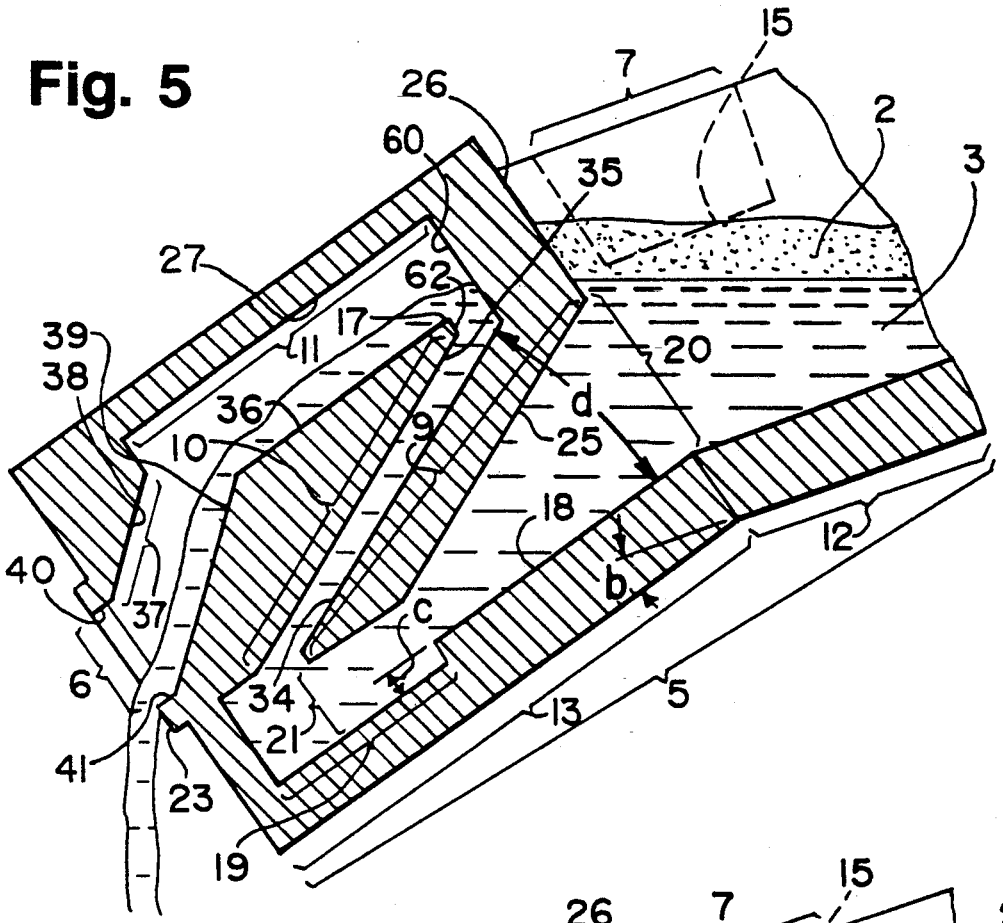
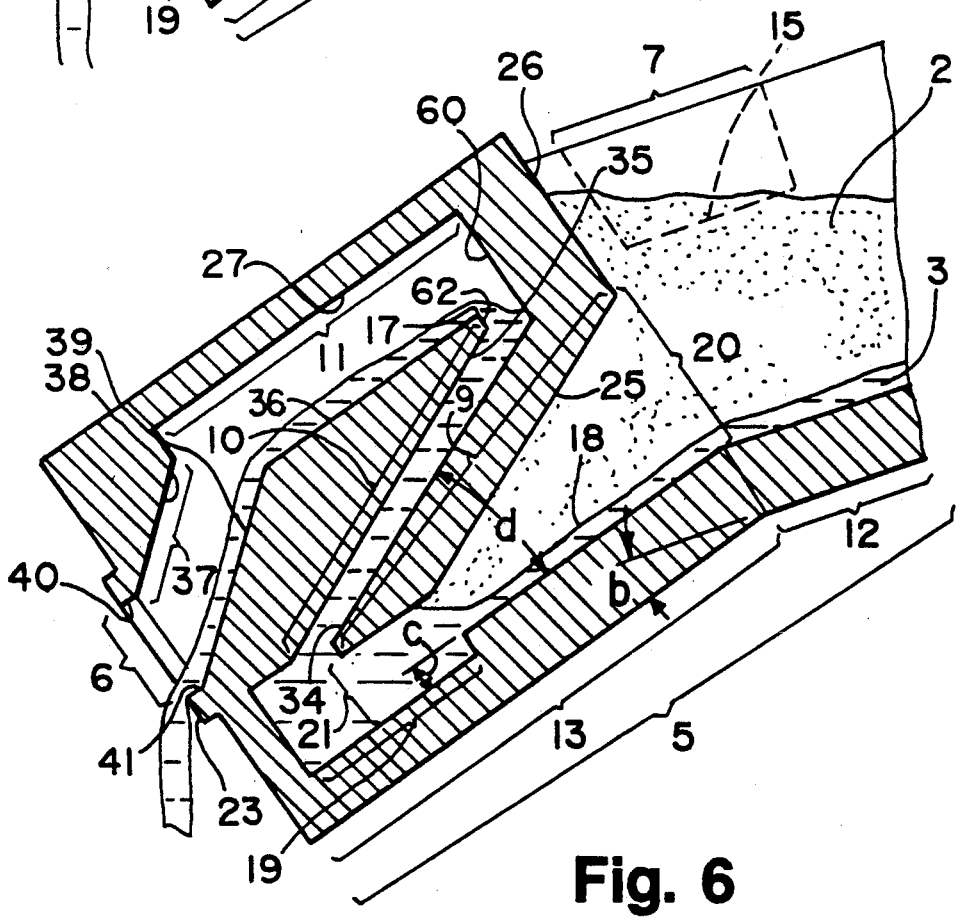
Fig. 6

Fig. 7
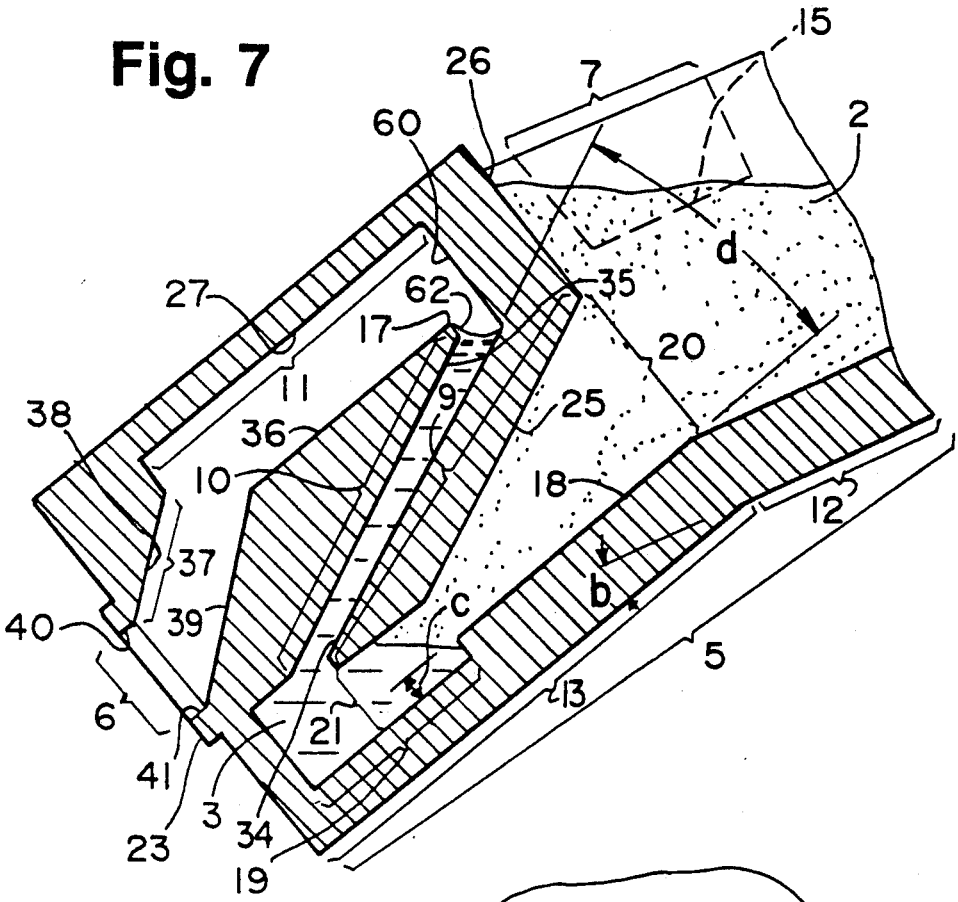
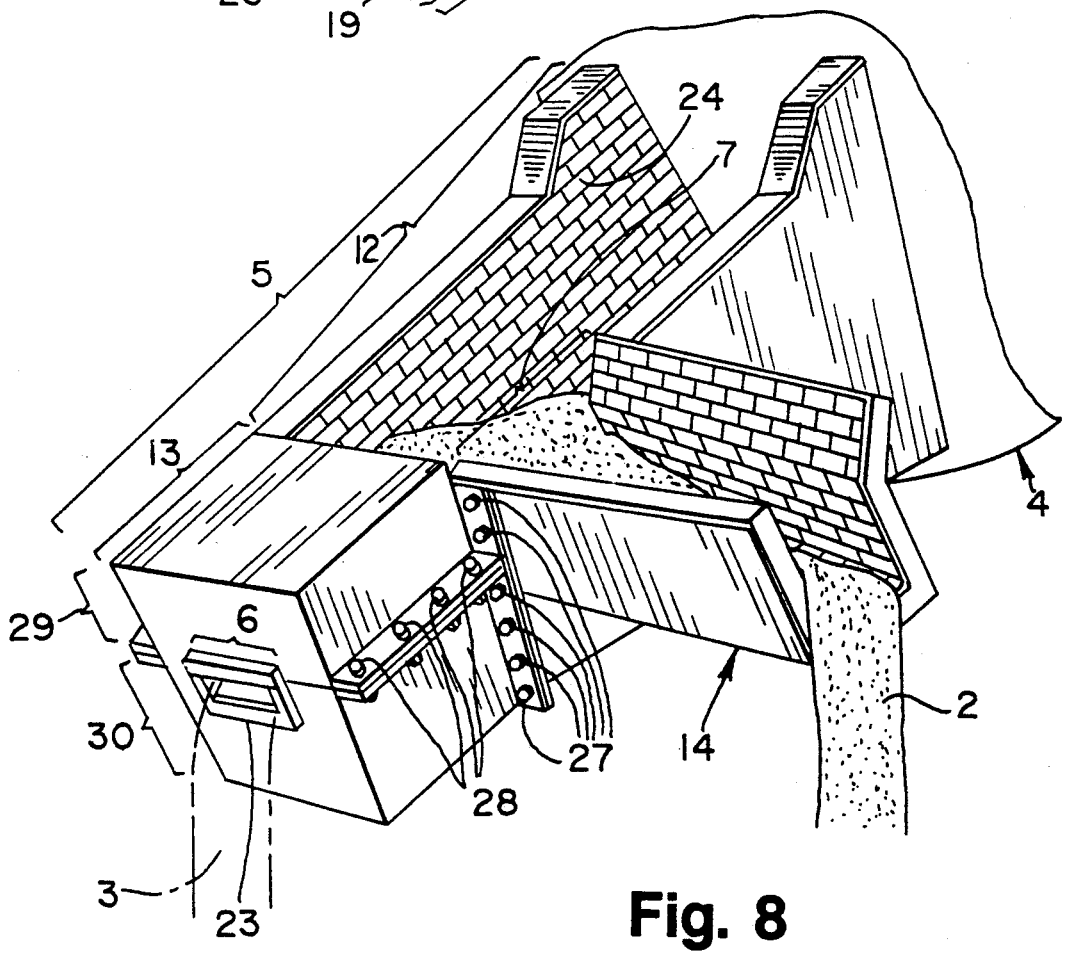
Fig. 8

SLAG CONTROL APPARATUS AND METHOD

CROSS-REFERENCE TO RELATED APPLICATION

This application is a continuation-in-part of the copending U.S.A. patent application Ser. No. 07/560,598, filed on Jul. 31, 1990 by William S. Laszlo.

TECHNICAL FIELD

The present invention relates generally to a method and apparatus for removing slag that separates from molten metal, and more particularly to a method and apparatus for removing slag that separates from molten metal which is discharged from a tilting electric arc furnace.

BACKGROUND OF THE INVENTION

When scrap metal is heated to a liquid, molten state, certain impurities may be separated from the molten metal by the introduction of conventional fluxes which react with the impurities to form what is conventionally known as furnace slag. This slag rises to the surface and floats on top of the molten metal.

Slag is of little or no value in making use of the molten metal from the furnace. To the contrary, furnace slag can interfere with alloy additives in making various metal specifications.

For example, in making alloyed steel, soluble oxygen is an unwanted contaminant. Slag which rises to the top of molten steel contains a large amount of soluble oxygen. If slag is present when alloys are added to the molten steel, then the soluble oxygen in the slag will react with the alloys and inhibit the alloys from reacting with the molten steel. Thus, the slag inhibits the alloying process. Also, the presence of slag in the molten steel facilitates the formation of particulate inclusions which, if large enough, may be detrimental to the physical properties of the steel.

Since furnace slag is a contaminant which may have a deleterious effect on making alloy steels, it is desirable to separate the slag from the molten metal before alloys are added to the molten metal. Therefore, slag separation is usually done before alloys are added to the molten steel. Any slag which is separated is usually discarded. The process of separating slag from molten steel is often known as slag control.

Slag control has been a particularly difficult problem when scrap steel is melted in tilting furnaces and then discharged into a container or "ladle" before adding alloys. As discussed below, there have been numerous attempts at separating slag from molten steel that is discharged from a tilting furnace.

The typical electric furnace is mounted on a tilting platform. A tap hole is located on the side of the furnace. A trough is mounted on the side of the furnace, just below the tap hole.

When the furnace is heated, scrap steel in the furnace melts into a molten liquid state. Slag separates from the molten steel and floats in a separate layer on top of the molten steel.

The tap hole is opened when the furnace is in the upright position. When the tap hole is opened, it is usually located above the level of the floating slag and molten metal. However, in some cases, it may be located below the level of the floating slag.

When the furnace is tilted, the operator of the furnace will attempt to tilt the furnace sufficiently so that the tap hole is below the top of the molten metal and permits the molten steel to flow through the tap hole. The slag remains inside the furnace and floats at a level above the level of the tap hole. As the molten steel drains from the furnace, the operator increases the angle of tilt in order to keep the slag at a level above the level of the tap hole. Thus, the operator attempts to cause all of the molten steel to flow through the tap hole before the slag begins to flow through the tap hole. This process of pouring or tapping is conventionally known as the "tap."

As slag floats on top of molten steel, there is a very fluid layer of floating slag, known as interface slag, which floats in a layer between the molten steel and the rest of the floating slag. The interface slag has much less viscosity, and a higher concentration of soluble oxygen, than the rest of the floating slag. Interface slag is particularly deleterious to the alloying process.

While molten steel is flowing through the tap hole, a vortex forms. The vortex draws interface slag through the tap hole while the molten steel is flowing through the tap hole.

The operator cannot see the vortexing of the interface slag because the furnace is usually enclosed on all sides and the top. Therefore, there is very little that the operator can do to prevent the interface slag from contaminating the molten steel during the tap.

During the tap, the level of the molten metal and floating slag in the furnace falls until the floating slag is at the level of the tap hole. At this point, the floating slag will begin to flow through the tap hole and contaminate the molten steel which has already been poured from the furnace. In order to prevent the flow of slag through the tap hole, the operator attempts to stop the tapping process quickly by closing the tap hole and/or returning the furnace to the upright position.

However, because a tilting furnace is usually fully enclosed, the operator usually cannot see inside the furnace to determine exactly when the slag is about to flow through the tap hole. Therefore, the operator usually waits until he sees slag coming out of the tap hole and into the trough before attempting to stop the flow of slag and returning the furnace to the upright position. This is the traditional method of slag control in a tilting furnace.

There have been numerous attempts to supplement or improve this basic method of slag control on tilting furnaces, including tap hole gates, Vost-Alpine slag stoppers, the E-M-L-I system, and various stopper devices or plugs.

Tap hole gates are sliding or rotary gates which are mounted on the outside of the furnace adjacent the tap hole. The operator closes the gate when slag begins to discharge from the tap hole.

The Vost-Alpine slag stopper is a large, articulating nitrogen gas cannon which is used to close the tap hole. Operating under very high pressure, the cannon discharges nitrogen gas into the tap hole of the furnace on demand, and this stops the flow of molten steel and slag through the tap hole. Thus, the Vost-Alpine slag stopper is a kind of tap hole gate.

The E-M-L-I system consists of an electronic sensor which is mounted to the furnace inside the tap hole refractory. The E-M-L-I senses when a predetermined percentage of slag is entrained in the molten metal which is flowing through the tap hole. When the predetermined percentage is sensed by the E-M-L-I unit, the sensor communicates this to the operator of the furnace, who will then return the furnace to the upright position. Thus, the E-M-L-I system is used to control slag by directing the operator of the furnace to stop flow through the tap hole as soon as a predetermined amount of slag begins to flow through the tap hole.

A variety of stopper devices or plugs are used to control slag. They have a variety of shapes including the shapes of a tetrahedron or globe (also known as "cannonball"). A plug is placed inside the furnace and floats in the interface between the molten metal and floating slag. When the interface and plug drop to the level of the tap hole during the course of a tap, the plug is drawn by suction to the tap hole and blocks flow through the tap hole.

The eccentric bottom tapping gate is another attempt at slag control in an electric arc furnace. It requires that the tap hole be made in the bottom, rather than the side, of the furnace. When the operator observes slag pouring from the furnace, he closes a sliding gate to block the tap hole and prevent further flow through the tap hole. This method of slag control is quite expensive because it requires modification of an existing furnace to create a virtually new furnace and new ladle transfer cars or turrets to receive the molten steel as it is discharged from the furnace. The ladles must be moved from the side of the furnace and placed underneath the bottom of the furnace.

None of these prior methods of slag control for a tilting furnace has performed particularly well. None of them solves the problem of contamination of the molten steel with interface slag which vortexes through the tap hole while molten steel is flowing through the tap hole. None of them solves the problem of contamination of the molten steel with slag which flows through the tap hole at the end of a tap before the operator can react to stop the flow through the tap hole. Most of them also stop the flow of some of the molten steel thus reducing the yield.

In the prior art known to the inventor, there is no known method or apparatus to control slag after it escapes through the tap hole of a tilting furnace. All of the prior art methods and apparatuses known to the inventor have simply attempted to stop flow through the tap hole when it is determined that all of the molten steel has been discharged through the tap hole and floating slag is beginning to flow through the tap hole. None of these prior art methods and apparatuses control or remove the slag after it goes through the tap hole and into the trough.

It would be desirable to control slag in a tap discharge of molten metal after it flows through the tap hole into the trough and before it flows out of the trough and into the ladle.

It would also be beneficial too if such an improved system could be effectively and readily employed on a tilting electric arc furnace having an attached discharge trough.

Additionally, such an improved system should provide for positive separation and control of the slag, including interface slag, from the molten metal.

Further, it would be desirable to provide an improved system which would permit the viewing of the level of molten metal and floating slag in the trough in order to coordinate the separation of the slag and metal, as well as the retention and discharge of the slag in a positive manner.

Finally, it would be beneficial to provide such a system which can be implemented by apparatus that can be removed and replaced as necessary, without requiring removal or replacement of the entire trough or furnace.

While the slag control method and apparatus disclosed in patent application Ser. No. 07/560,598, filed Jul. 31, 1990 generally provides the above-discussed advantages and benefits, the present invention disclosed in this continuation-in-part application contains additional improvements.

SUMMARY OF THE INVENTION

This invention provides an apparatus and method for controlling slag in a tap discharge of molten metal and floating slag from a tap hole of a tilting furnace which is variably tiltable between an upright, non-tilted position and a fully tilted position.

The apparatus includes a trough extending outwardly from the tap hole. Thus the trough moves with the furnace. The trough has a discharge outlet and a lateral opening inwardly of the discharge outlet.

In one form of the invention, the trough has a passage means for defining a lower passage outwardly of the lateral opening, an intermediate passage extending upwardly from the lower passage and inwardly toward the furnace, and an upper passage extending outwardly from the intermediate passage toward the discharge outlet.

According to another aspect of the invention, the trough may have a passage means for defining a generally Z-shaped flow path between the lateral opening and the discharge outlet.

The method of the present invention includes the steps of sufficiently tilting the furnace and trough to discharge molten metal and slag from the tap hole into the trough whereby the molten metal can flow under the influence of gravity out of the discharge outlet. The flow of molten metal is directed through the defined flow path in the trough, and the slag is dammed and retained in the trough while the molten metal is permitted to flow out of the discharge outlet. The retained slag is discharged through the lateral opening to a location remote from the discharge outlet.

Other features and advantages of the present invention will become readily apparent from the following detailed description, accompanying drawings, and appended claims.

BRIEF DESCRIPTION OF THE DRAWINGS

The invention is described in greater detail in the following description of the preferred embodiment, taken in conjunction with the drawings, in which:

FIG. 1 is a fragmentary, perspective view showing a preferred embodiment of the slag control apparatus of the present invention shown mounted on a tilting electric furnace;

FIG. 2 is a simplified, reduced scale, side elevational view of the slag control apparatus and the tilting furnace with the furnace in the normal vertical position and with a portion of the furnace wall cut away to illustrate interior detail;

FIG. 3 is a fragmentary, cross-sectional view, taken generally along the plane 3—3 in FIG. 1, of a portion of the slag control apparatus with the furnace having been tilted 16° from the normal upright position shown in FIG. 1 and held in that position for approximately 10 seconds after the molten metal and slag have been discharging from the furnace;

FIG. 4 is a view similar to FIG. 3, but showing the apparatus after the molten metal and slag have been discharging from the furnace for approximately 40 seconds;

FIG. 5 is a view similar to FIG. 3, but showing the apparatus just after the furnace has been further tilted to 36°;

FIG. 6 is a view similar to FIG. 5, but showing the apparatus about 10 seconds after the furnace has been tilted 36° and held in that position;

FIG. 7 is a view similar to FIG. 6, but showing the apparatus after the furnace has been tilted 41° and held in that position until the end of the tap; and FIG. 8 is a similar view to FIG. 1, but showing the furnace in a tilted position for discharging the molten steel and slag through the apparatus of the present invention.

DETAILED DESCRIPTION

While the present invention may be embodied in various forms, a preferred embodiment is shown in the drawings and is described below. However, this description of a preferred embodiment is not intended to limit the scope of the invention to the disclosed embodiment. The principles of the invention may be embodied in various other forms which are not described herein.

As seen in FIG. 1, a trough 5 is mounted to, and extends outwardly from, the side of a conventional tilting electric furnace 4, which furnace is variably tiltable between a non-discharging, vertical, upright position and a final, discharging, fully-tilted position which is about 36°–41° from vertical (FIG. 7).

The trough 5 may be any suitable means for holding molten metal and directing it outwardly from the side of the tilting furnace 4.

Preferably, the trough 5 is divided into an inner trough portion 12 and an outer trough portion known as the nose piece 13, wherein the inner trough portion 12 is permanently affixed to the furnace 4 and the nose piece 13 is connected to, and detachable from, the inner trough portion 12, as further described in detail below.

Preferably, as shown in FIGS. 1 and 8, the inner trough portion 12 is a steel trough lined with two layers of conventional refractory brick 24, suitable for the operating temperature. The inner trough portion 12 extends from the side of the furnace just below a tap hole 25, as seen in FIG. 2. The inner trough portion 12 usually extends outwardly from the furnace 4 at an angle "a" of about 5° to 15° above horizontal when the furnace is upright. The inner trough portion 12 is preferably permanently affixed to the furnace 4 so that it will move along with the furnace 4.

The inner trough portion defines a lateral opening 7 in a side wall adjacent the outer trough portion 13, and the opening 7 communicates with a slag chute 14 which extends from one side of the inner trough portion 12. For ease of understanding of the apparatus and its operation, the superimposed position of the lateral opening 7 is shown in phantom in FIGS. 3–7 wherein it is depicted in dashed lines. The lateral opening 7 is adjacent the nose piece 13, as shown in all Figures.

The lateral opening 7 has a bottom 15 which must be positioned to be able to remain above the level of the molten steel 3 and below the level of the floating slag 2 during the tap so as to allow the slag 2, but not the molten metal 3, to flow through the lateral opening 7 into the slag chute 14. The positioning of the lateral opening is discussed in greater detail below, after additional description of other parts of the invention.

Preferably, the nose piece 13 comprises refractory material within the confines of a steel shell. The nose piece 13 is connected to the inner trough portion 12 with bolts 27, as shown in FIG. 1. Thus, the nose piece 13 is detachable from the inner trough portion 12 for easy maintenance or replacement.

The nose piece 13 extends outwardly and is oriented at an angle "b" relative to the inner trough portion 12, as shown in FIGS. 2–7. Preferably, the angle "b" is the same as the angle "a" (FIG. 2) so that the nose piece 13 is substantially horizontal when the furnace is upright.

The steel shell for the nose piece 13 may be divided into an upper part 29 and a lower part 30 which are connected by bolts 28, as shown in FIG. 1. Preferably, the upper part 29 and lower part 30 are connected by a hinge (not illustrated) to permit pivotal movement of the upper part between a closed operative position and an open access position. When the top part 29 is in the open access position, the interior of the nose piece 13 may be accessed for maintenance.

The steel shell for the nose piece is lined with refractory paper, such as that sold under the trademark "FIBERFRAX". The refractory material is placed within the steel shell. The refractory material may be any suitable, conventional, cast refractory material or refractory brick. The composition of the refractory material can vary depending upon temperature requirements.

The refractory material in the nose piece 13 defines an inlet 20, a discharge outlet 6, and a connecting discharge passage which permits the flow of molten metal from the inlet 31 to the discharge outlet 6, as described in detail below.

Preferably, the discharge passage has three basic parts: a lower passage 9, an intermediate passage 10, and an upper passage 11. These passages are defined by surrounding refractory which forms the walls of the passages.

The lower passage 9, which extends between the upstream inlet 20 and a downstream end 21, is defined by refractory forming a lower passage bottom wall 18, two opposed lower passage side walls (not illustrated), and an upper passage top wall 25, as shown in FIGS. 3–7.

The lower passage bottom wall 18 is generally flat and parallel to the bottom of the nose piece which is oriented at an angle "b" as indicated in FIGS. 3–7. The lower passage bottom wall 18 and the longitudinal axis of the lower passage 9 are substantially horizontal when the furnace 4 is in the upright position.

The lower passage bottom wall 18 has a recessed area or depression 19 at the downstream end 21 of the lower passage 9. The depth of the depression 19 is indicated by the dimension "c". In a preferred embodiment, the depression is 3 inches deep.

The depression 19 retains molten metal after a tap is completed and the furnace is returned to the upright position. The retained molten steel keeps the nose piece 13 at an elevated temperature between taps which minimizes thermal cracking and subsequent deterioration.

The lower passage side walls (not illustrated) are substantially flat, vertical and parallel to each other. Thus, the width of the lower passage 9 remains constant from the inlet 20 to the downstream end 21. In a preferred embodiment, the width of the lower passage 9 is approximately 22 inches.

The lower passage top wall 25 is divided into an angled portion and a horizontal portion. The angled portion is oriently an angle inwardly and upwardly. Thus, the height and cross-sectional area of the inlet 20 of the lower passage 9 are greater than the height and cross-sectional area of the downstream end 21 of the lower passage 9.

In a preferred embodiment, the inlet 20 of the lower passage 9 has a square cross-section of approximately 22 inches on a side. At the downstream end 21 of the lower passage 9 which includes the depression 19, the cross-section is 9 inches high and 22 inches wide. The decrease in cross-sectional area from the inlet 20 to the downstream end 21 of the lower passage 9 creates a gradual constriction in the lower passage 9 thereby facilitating a smooth flow of molten metal 3 through the lower passage 9.

The lower passage top wall 25 terminates in a rear face 26, as shown in FIGS. 3–7. The lower passage top wall 25 and rear face 26 act as a dam to retain the slag 2 in the trough 5 while permitting the flow of molten metal 3 into the lower passage 9.

The intermediate passage 10 is defined for most of its length by refractory forming an inner wall 34, an outer wall 35, and two intermediate passage side walls (not illustrated).

The inner wall 34 and outer wall 35 are flat and parallel, and are oriented at an angle "d" upwardly and inwardly from the lower passage bottom wall 18, as shown in FIGS. 3–7. The two side walls are flat, vertical and parallel. Thus, the inner wall 34, outer wall 35, and two side walls define the intermediate passage 10 which is substantially straight, has a uniform cross-section, and is oriented at an angle "d" upwardly and inwardly from the lower passage 9.

In a preferred embodiment, inner wall 34 and outer wall 35 are approximately 45 inches long and spaced approximately 6 inches apart. The two intermediate passage side walls are spaced approximately 22 inches apart. Thus, the intermediate passage 10 is approximately 45 inches long and has a uniform cross-section which is approximately 6 inches high and 22 inches wide.

Preferably, the intermediate passage 10 also includes a short vertical section defined between the side walls by a lower portion of a rear wall 60 and a confronting front wall 62. The front wall 62 has a top edge or top 17.

Also, in a preferred embodiment, the major length of the intermediate passage 10 is oriented at the angle "d" which can range from approximately 15° to approximately 60° from horizontal when the furnace 4 is in the upright position. Thus, in a tilting furnace which tilts up to 45°, the intermediate passage tilts with the furnace toward a vertical or nearly vertical orientation when the furnace 4 is fully tilted (FIG. 7). In a presently contemplated preferred embodiment, the angle "d" is approximately 23°.

The outer wall 35 of the intermediate passage 10 functions as a weir by creating a pressure rise in the intermediate passage 10 and a minimum depth of molten metal flow in the inner tough portion 12. As molten metal 3 flows through the nose piece, it must rise through the intermediate passage 10 and spill over the top edge 17 of the front wall 62, as shown in FIGS. 4–7. There is a pressure rise at the bottom of the intermediate passage 10 and in the lower passage 9 created by the rising level of the molten metal 3 in the intermediate passage 10. The pressure rise restricts flow through the lower passage and creates a minimum depth of flow in the inner trough portion 12. The minimum depth is associated with the height of the outer wall 35 and top edge 17 of the intermediate passage 10, as will be more fully described below.

The upper passage 10 is defined by refractory forming an upper passage top wall 27, two upper passage side walls (not illustrated), and an upper passage bottom wall 36.

The upper passage top wall 27 and bottom wall 36 are substantially flat and parallel to each other. They are substantially parallel to the lower passage bottom wall 18. Thus, they are substantially horizontal when the furnace 4 is in the upright position.

The upper passage side walls are substantially flat and parallel to each other.

In a preferred embodiment, the upper passage top wall 27 is spaced approximately 10 inches from the upper passage bottom wall 36, and the upper passage side walls are spaced approximately 22 inches from each other. Thus, the upper passage 11 has a uniform rectangular cross-section which is 10 inches high and 22 inches wide.

An exit passage 37 extends outwardly and downwardly from the upper passage 11. The exit passage 37 is defined by refractory forming an exit passage bottom wall 39, an exit passage top wall 38, and two opposed exit passage side walls (not illustrated).

The exit passage bottom wall 39 and exit passage top wall 38 are substantially flat and parallel to each other and the exit passage side walls are substantially flat and parallel to each other.

In a preferred embodiment, the exit passage bottom wall 39 is spaced approximately 10 inches from the exit passage top wall 38, and the exit passage side walls are spaced 22 inches from each other. Thus, the exit passage has a uniform rectangular cross-section which is approximately 10 inches high and 22 inches wide.

The heights of the cross-sections of the upper passage 11 and exit passage 37 are large enough to create an ambient air cavity in the upper passage 11 and exit passage 37 above the flowing molten metal, as shown in FIGS. 4–6. The air cavity prevents a siphon effect in the upper passage 11 and exit passage 37.

The exit passage 37 terminates at the discharge outlet 6 located at the distal end of the nose piece 13. The discharge outlet 6 is defined in part by a discharge outlet upper wall 40 and a discharge outlet bottom wall 41. A lip 23 extends outwardly below the discharge outlet and functions to direct the flow of molten metal 3 outwardly and away from the discharge outlet 6.

In the preferred embodiment described herein, the orientation of the discharge passage including the lower passage 9, intermediate passage 10, upper passage 11, and exit passage 37 results in a generally Z-shaped flow path as shown in FIGS. 3–7. The Z-shaped flow path creates a pressure rise and the minimum depth of flow in the inner trough portion 12. It communicates between the inlet 20 and the discharge outlet 6.

However, the orientation of the discharge passage need not create a Z-shaped flow path. For example, the flow path could change directions and discharge through a lateral opening rather than the discharge outlet 6 described and illustrated herein.

As discussed above, the lateral opening 7 in the trough 5 must be located at a height which allows slag 2 but not molten metal 3 to discharge through the lateral opening 7. Since the molten metal 3 in the trough 5 rises to approximately the same level as the top edge 17 of the intermediate passage 10 (which functions as a weir), it is preferable to locate the bottom 15 of the lateral opening 7 of the trough 5 at approximately the same level as the top edge 17 of the intermediate passage 10, as they are oriented when the furnace is tilted during the course of a tap. If the bottom 15 of the lateral opening 7 is positioned as such, then the floating slag 2, but not the molten metal 3, will flow through the lateral opening 7 when the furnace 4 is tilted during the course of a tap, as shown in FIGS. 3–7.

When the furnace is in the upright position, the bottom 15 of the lateral opening 7 may be above, at, or below the level of the top edge 17 of the intermediate passage 10, depending on the configuration and orientation of the furnace 4 and trough 5.

Preferably, when the furnace 4 is in the upright position (FIG. 2), the bottom 15 of the lateral opening 7 should be approximately 3 inches below the top edge 17 of the intermediate passage 10, or within a range of 6 inches above to 10 inches below the top edge 17 of the intermediate passage 10. These are approximations which will vary depending upon the configuration and orientation of the furnace 4 and trough 5.

In the practice of the method of the invention, there is a preliminary step wherein the furnace is heated and the metal is melted. This is called charging the furnace. The furnace may be charged so that the slag layer 2 is below the tap hole 25 as illustrated in FIG. 2. However, the slag layer 2 could initially be above the tap hole 25.

The tap begins by tilting the furnace 4 sufficiently in order to lower the tap hole 25 to a level well below the level of the floating slag 2. The molten metal 3 flows through the tap hole 25 while the floating slag 2 remains inside the furnace 4. As the molten metal 3 drains from the furnace 4, the operator increases the tilt of the furnace 4 in order to keep the floating slag 2 above the level of the tap hole 25.

When the molten metal 3 initially flows into the trough 5, it will begin to fill the bottom of the trough 5 and lower passage 9, as shown in FIG. 3. In FIG. 3, the furnace is tilted approximately 16° from the vertical such that the bottom of the inner trough portion 12 is substantially horizontal, and the nose piece 13 and the lower passage bottom wall 18 are tilted approximately 16°.

After the furnace is tilted approximately 16° and held in that position for approximately 40 seconds, the inner trough portion 12, the lower passage 9, and the intermediate passage 10 have become filed with molten metal 3 as shown in FIG. 4. The molten metal 3 spills over the top edge 17 of the intermediate passage 10, flows through the upper passage 11 and exit passage 37, and discharges through the discharge outlet 6.

As discussed above, the molten metal 3 flowing through the tap hole 25 will tend to vortex. The vortexing of the molten metal 3 will draw interface slag from the floating furnace slag down into the tap hole 25 where the interface slag will flow with the molten metal 3 through the tap hole 25 and into the trough 5.

Although vortexing occurs as molten metal 3 flows through the tap hole 25, no vortexing occurs as molten metal 3 flows through the lower passage 9. It is believed that the rectangular shape of the cross-section the lower passage 9 inhibits and/or prevents significant vortexing.

The interface slag which is drawn into the trough 5 separates from the molten metal 3 and rises to the surface to form part of the layer of floating slag 2 in the trough 5.

During the tap, when the molten metal 3 is flowing in the trough 5, the operator may view the trough 5 from an elevated vantage point which allows him to see into the slag chute 14 and trough 5. He can adjust the tilt of the furnace 4 to control the rate at which the molten metal 3 and slag 2 is flowing through the tap hole 25 and into the trough 5 and thereby control the level of molten metal 3 and slag 2 in the trough 5 during the tap. If the depth of molten metal 3 and slag 2 in the trough 5 becomes too great, then the operator can slow down, or temporarily stop or reverse, the tilting of the furnace 4.

As the molten metal 3 is drained from trough 5, the operator gradually increases the tilt of the furnace 4 to maintain the depth of molten metal 3 and slag 2 in the trough 5. As seen in FIGS. 4–7, when the molten metal 3 is discharging from the trough 5, the level of molten metal 3 in the trough 5 is always kept below the bottom 15 of the lateral opening 7, while some of the thickness of the layer of floating slag 2 is kept above the bottom 15 of the lateral opening 7. Thus, molten metal 3 does not flow through the lateral opening 7, but floating slag 2 does flow through the lateral opening 7 into the slag chute 14 as shown in FIG. 8.

As the amount of floating slag 2 in the trough 5 increases, the thickness of the layer of floating slag 2 will increase. FIGS. 4–6 show this increase in the depth of floating slag 2.

After the molten metal 3 has substantially drained from the furnace 4, most of the remaining floating slag 2 in the furnace 4 will continue to flow through the tap hole 25 and into the trough 5. This will usually begin to occur when the furnace 4 is tilted to approximately 35° to 38° from vertical, in a conventional electric arc furnace which tilts from 0° to approximately 45° from vertical. As the furnace 4 continues to tilt to its fully-tilted position, this flow of slag 2 through the tap hole 25 will cause the amount of slag 2 in the trough 5 to greatly increase. This flow of slag 2 through the tap hole will be evident to the operator, who will see an increase in the amount of floating slag 2 in the trough 5.

After all of the molten metal 3 has been drained from the furnace 4 into the trough 5, the molten metal 3 in the trough 5 will stop flowing over the top edge 17 of the intermediate passage 10 and will remain at the level of the top edge 17 as shown in FIG. 7. After this occurs, and after the slag 2 has fully discharged from the trough 5 through the lateral opening 7, the operator stops any further tilting of the furnace 4 and returns the furnace 4 to the upright position. Note, the density of the slag 2 is much less than the molten metal 3, and the level of slag in the inner trough 12 is not sufficient to overcome the static head of the molten metal in the intermediate passage 10. Thus, the slag 2 does not flow through the nose piece 13 and out of the outlet 6.

As the operator returns the furnace 4 to the upright position, some molten metal 3 will be retained in the depression 19 in the lower passage bottom wall 18. This molten metal 3 will maintain a high temperature throughout the nose piece 13 and deter thermal cracking and other temperature-related deterioration for a short period of time, until the next tap begins.

Thus, this invention controls slag in a tap discharge of molten metal and floating slag by employing a novel apparatus and method for directing the flow of the molten metal through a novel flow path in a trough, damming and retaining the slag when it is in the trough, and allowing the molten metal to flow out of the trough while allowing the slag to flow through a lateral opening in the trough and into a slag chute. By using this combination of a unique flow path and a lateral opening on a discharge trough, both moveable with the tilting furnace and trough, this invention effectively controls, and ultimately separates, slag in a tap discharge from a tilting electric arc furnace.

What is claimed is:

1. An apparatus for controlling slag in a tap discharge of molten metal and slag from a tap hole of a tilting furnace which is variably tiltable between an upright, non-tilted position and a fully-tilted position, said apparatus comprising:

a trough extending outwardly from said tap hole and having a discharge outlet from which said molten metal can be discharged, said trough defining a lateral opening located inwardly of said discharge outlet and from which said slag can be discharged, said trough having a passage means for defining a generally Z-shaped flow path between said lateral opening and said discharge outlet.

2. An apparatus in accordance with claim 1 wherein said Z-shaped flow path defined by said passage means includes a lower passage outwardly of said lateral opening, an intermediate passage extending upwardly from said lower passage and inwardly toward said furnace, and an upper passage extending from said intermediate passage toward said discharge outlet.

3. An apparatus in accordance with claim 1 wherein said trough includes an inner trough portion and an outer trough portion, said inner trough portion being connected to said furnace and defining said lateral opening, said outer trough portion being connected to said inner trough portion and defining said passage means; and said apparatus further includes a slag chute mounted to, and extending laterally from, said inner trough portion at said lateral opening for directing said slag to a preselected deposit region.

4. An apparatus in accordance with claim 1 wherein said lateral opening is adjacent said passage means.

5. An apparatus for controlling slag in a tap discharge of molten metal and slag from a tap hole of a tilting furnace which is variably tiltable between an upright, non-tilted position and a fully-tilted position, said apparatus comprising:

a trough extending outwardly from said tap hole and having a discharge outlet from which said molten metal can be discharged, said trough defining a lateral opening located inwardly of said discharge outlet and from which said slag can be discharged, said trough having a passage means for defining a lower passage outwardly of said lateral opening, an intermediate passage extending upwardly from said lower passage and inwardly toward said furnace, and an upper passage extending away from said intermediate passage and toward said discharge outlet.

6. An apparatus in accordance with claim 5 wherein said passage means defines a generally Z-shaped flow path.

7. An apparatus in accordance with claim 5 wherein said trough includes an inner trough portion and an outer trough portion, said inner trough portion being connected to said furnace and defining said lateral opening, said outer trough portion being connected to said inner trough portion and defining said passage means; and said apparatus further includes a slag chute mounted to, and extending laterally from, said inner trough portion at said lateral opening for directing said slag to a preselected deposit region.

8. An apparatus in accordance with claim 5 wherein said lateral opening is adjacent said passage means.

9. An apparatus in accordance with claim 5 wherein said intermediate passage is defined at least in part by an outer wall wherein said outer wall functions as a weir.

10. An apparatus in accordance with claim 9 wherein the bottom of said lateral opening is at a level which is located between, about 6 inches above to about 10 inches below the top of said outer wall when said furnace is in said upright, non-tilted position.

11. An apparatus in accordance with claim 9 wherein the bottom of said lateral opening is at a level which is at least as high as the top of said outer wall when said furnace is in said upright, non-tilted position.

12. An apparatus in accordance with claim 9 wherein the bottom of said lateral opening is at substantially the same level as the top of said outer wall when said furnace is in said upright, non-tilted position.

13. An apparatus in accordance with claim 9 wherein the bottom of said lateral opening is below the level of the top of said outer wall when said furnace is in said upright, non-tilted position.

14. An apparatus in accordance with claim 9 wherein the bottom of said lateral opening is at a level which is approximately 3 inches below the level of the top of said outer wall when said furnace is in said upright, non-tilted position.

15. An apparatus in accordance with claim 5 wherein the longitudinal axes of said lower passage and said upper passage are substantially horizontal when said furnace is in said upright, non-tilted position.

16. An apparatus in accordance with claim 5 wherein said lower passage is defined at least in part by a lower passage bottom wall, said bottom wall defining a depression for retaining molten metal when said furnace is in said upright, non-tilted position.

17. An apparatus in accordance with claim 5 wherein said lower passage has an inlet and a downstream end, said lower passage having a cross-sectional area at said inlet which is greater than the cross-sectional area at said downstream end.

18. An apparatus in accordance with claim 5 wherein said upper passage is defined at least in part by an upper passage top wall and an upper passage bottom wall, said upper passage top wall being sufficiently spaced from said upper passage bottom wall to permit the entry of outside air from said discharge outlet into said upper passage while said molten metal is flowing out of said discharge outlet.

19. An apparatus in accordance with claim 5 wherein said discharge outlet is defined in part by a discharge outlet top wall and a discharge outlet bottom wall, said discharge outlet top wall being sufficiently spaced from said discharge outlet bottom wall to permit entry of outside air into said upper passage while molten metal is flowing out of said discharge outlet.

20. An apparatus in accordance with claim 5 wherein said intermediate passage has a generally straight length which is substantially vertical when said furnace is in said fully tilted position.

21. An apparatus in accordance with claim 5 wherein said intermediate passage has a generally straight length which is oriented at an angle of between approximately 15° and approximately 60° from the horizontal when said furnace is in said upright, nontilted position.

22. An apparatus in accordance with claim 21 wherein said angle is approximately 23°.

23. An apparatus in accordance with claim 5 wherein said intermediate passage is approximately 45 inches long.

24. An apparatus in accordance with claim 5 wherein said intermediate passage has a rectangular cross-section which is approximately 6 inches high and 22 inches wide.

25. An apparatus in accordance with claim 5 wherein at least a portion of said upper passage has a rectangular cross-section which is approximately 10 inches high and 22 inches wide.

26. An apparatus in accordance with claim 5 wherein said upper passage is defined at least in part by an upper passage top wall, said upper passage top wall being pivotally moveable between an operative position and an access position.

27. An apparatus in accordance with claim 5 wherein said inlet of said lower passage has a square cross-section of approximately 22 inches on a side.

28. An apparatus in accordance with claim 1 including a lip extending outwardly from the bottom of said discharge outlet.

29. An apparatus for controlling slag in a tap discharge of molten metal and slag from a tap hole of a tilting furnace which is variably tiltable between an upright, non-tilted position and a fully-tilted position, said apparatus comprising:

an inner trough portion mounted to said furnace and extending outwardly from said tap hole, said inner trough portion having a distal end and defining a lateral opening inwardly of said distal end;

a slag chute mounted to, and extending laterally from, said inner trough portion at said lateral opening for directing said slag to a preselected deposit region; and an outer trough portion mounted to, and extending outwardly from, said distal end of said inner trough portion, said outer trough portion including refractory defining an inlet, a discharge outlet, and a passage means communicating between said inlet and said discharge outlet for permitting the flow of said molten metal along a substantially Z-shaped path through said outer trough portion from said inlet to said discharge outlet.

30. A method for controlling slag in a tap discharge of molten metal and floating slag from a tap hole of a tilting furnace which is variably tiltable between an upright, non-tilted position and a fully tilted position, said furnace having a trough extending outwardly from said tap hole to a discharge outlet, said trough defining a lateral opening located inwardly of said discharge outlet and from which said slag can be discharged, said method comprising the steps of:

(a) sufficiently tilting said furnace and trough to discharge said molten metal and slag from said tap hole into said trough whereby said molten metal can flow under the influence of gravity out of said discharge outlet;

(b) directing said flow of molten metal through a generally Z-shaped flow path in said trough;

(c) damming and retaining said slag in said trough while permitting said molten metal to flow out of said discharge outlet; and (d) discharging said retained slag through said lateral opening to a location remote from said discharge outlet.

31. The method in accordance with claim 30 wherein step (a) includes increasing the angle of tilt during said discharge of said molten metal and slag in step (a).

32. The method in accordance with claim 30 wherein said Z-shaped flow path is defined in said trough by a lower passage outwardly of said lateral opening, an intermediate passage extending upwardly from said lower passage and inwardly toward said furnace, and an upper passage extending away from said intermediate passage toward said discharge outlet;

said step (c) includes:

maintaining the level of said molten metal below the bottom of said lateral opening; and said step (d) includes:

maintaining the level of the top of said floating slag above at least a portion of the bottom of said lateral opening.

33. A method for controlling slag in a tap discharge of molten metal and floating slag from a tap hole of a tilting furnace which is variably tiltable between an upright, nontilted position and a fully tilted position, said furnace having a trough extending outwardly from said tap hole to a discharge outlet, said trough defining a lateral opening located inwardly of said discharge outlet and from which said slag can be discharged, said method comprising the steps of:

(a) sufficiently tilting said furnace and trough to discharge said molten metal and slag from said tap hole into said trough whereby said molten metal can flow under the influence of gravity out of said discharge outlet;

(b) directing said flow of molten metal through a lower passage outwardly of said lateral opening, an intermediate passage extending upwardly from said lower passage and inwardly toward said furnace, and an upper passage extending away from said intermediate passage toward said discharge outlet;

(c) damming and retaining said slag in said trough while permitting said molten metal to flow out of said discharge outlet; and (d) discharging said retained slag through said lateral opening to a location remote from said discharge outlet.

34. The method in accordance with claim 33 wherein step (a) includes increasing the angle of tilt during said discharge of said molten metal and slag in step (a).

35. The method in accordance with claim 33 wherein said step (c) includes:

maintaining the level of said molten metal below the bottom of said lateral opening; and said step (d) includes:

maintaining the level of the top of said floating slag in the trough above at least a portion of the bottom of said lateral opening.

36. An apparatus in accordance with claim 5 including a lip extending outwardly from the bottom of said discharge outlet.

* * * * *